US006206641B1

(12) United States Patent
Park et al.

(10) Patent No.: US 6,206,641 B1
(45) Date of Patent: Mar. 27, 2001

(54) MICRO FAN

(75) Inventors: Woang Sik Park, Suwon; Chang Keun Jun, Shiung, both of (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/336,335

(22) Filed: Jun. 18, 1999

(30) Foreign Application Priority Data

Jun. 29, 1998 (KR) ..... 98-24807

(51) Int. Cl.[7] ..... F04D 29/38
(52) U.S. Cl. ..... 416/182; 416/223 R; 416/DIG. 5
(58) Field of Search ..... 416/179, 182, 416/183, 185, 238, 243, 223 R, DIG. 2, DIG. 5

(56) References Cited

U.S. PATENT DOCUMENTS 5,288,203 * 2/1994 Thomas ..... 415/178
5,582,506 * 12/1996 Hong ..... 415/177
5,769,607 * 6/1998 Neely et al. ..... 416/189

* cited by examiner

*Primary Examiner*—Edward K. Look
*Assistant Examiner*—James M McAleenan
(74) *Attorney, Agent, or Firm*—Darby & Darby

(57) ABSTRACT

Disclosed is a micro fan. The micro fan comprises a hub rotatably mounted to a shaft, and a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 2°–12° of helical twist.

6 Claims, 5 Drawing Sheets

MICRO FAN

BACKGROUND OF THE INVENTION

1. Field of the Invention

The present invention relates to a micro fan, and more particularly, the present invention relates to a micro fan in which each blade has an airfoil-shaped cross-section and is applied with a helical twist by twisting at a predetermined angle a span between a root and a tip of the blade, to generate optimum volume flow rate and wind pressure when the blade is rotated, thereby improving rotational efficiency and reducing electric power consumption and rotation noise.

2. Description of the Related Art

Generally, a micro fan is mainly used in a limited space such as in a notebook computer or a personal computer, for cooling and dissipating driving heat existing in a driving device such as a micro-processor or a VGA card, which generates heat upon driving. In these days, it is the norm to use a single rotation type axial flow fan having a small size as a micro fan.

A micro fan is directly locked to a micro-processor or is independently attached to an inside structure in a notebook computer or the like. At this times due to the fact that capacity and speed of a CPU for respective driving devices are multiplied while a personal computer trends toward miniaturization of its components, because load capacity is rapidly raised, heat of a high temperature is generated.

This driving heat generated in the CPU can cause driving failure due to overheating when it is not properly cooled and can induce damage to main components of the computer, thereby resulting in a breakdown of the entire computer.

Accordingly, while cooling of a CPU, which is not considered as a crucial subject in the past, comes recently in the limelight as an important task which cannot be passed over, a CPU cooling fan which is used at the present stage, reveals a technical limitation by which it cannot perform a sufficient cooling function.

On the other hand, when performing a cooling function by using a micro fan, a method for increasing volume flow rate of the fan can be implemented. Volume flow rate of a fan is determined by various factors such as blade size, blade configuration, running rpm, etc., and specifically, because it is used in a fixed space, problems which can result from spatial limitations, electric power consumption and noise generation must be essentially dealt with.

Accordingly, a micro fan must be designed such that energy loss due to separation of flowing air is prevented, noise is reduced, flow loss between an inlet and an outlet of a blade is minimized and a static pressure rise is maximized, whereby a high performance of the micro fan can be accomplished.

Specifically, it was found through various experiments that most fan noise is caused by variables including rpm, gap between a blade tip and a duct, the number of blades, chord length, camber, the sweep of a blade, etc.

FIG. 1 is a front view illustrating a structure of a conventional micro fan which is generally used in these days. The drawing reference numeral 1 denotes a hub which is fastened to a shaft and is integrally rotated therewith, the drawing reference numeral 2 represents a plurality of blades which are integrally formed on a circumferential outer surface of the hub 1, and the drawing reference numeral 3 depicts a duct which surrounds the hub 1 and the plurality of blades 2 from the outside and guides air flow through a gap defined between the blade and the duct.

The hub 1 is a rotating member of a motor of the micro fan. A magnet is attached inside the hub 1, and if electric power is supplied to the hub 1, by an interaction between a stator coil being a fixed member and the magnet, the hub 1 is rotated.

The plurality of blades 2 function to supply outside air to a micro-processor while being integrally formed on the circumferential outer surface of the hub 1 and being integrally rotated therewith.

The duct 3 is placed radially outward of the blades 2, surrounds the blades 2, and performs a function of a guider which guides air sucked by the blades 2 into the micro-processor.

FIG. 2 is an enlarged partial plan view illustrating a blade configuration of the micro fan of FIG. 1. The blade 2 of the conventional micro fan has a configuration of a circular arc having a cross-section which is curved upward, and possesses one end which is coupled to the hub 1 and the other end which is inclined downward.

On the other hand, the duct 3 which is separated by a fine gap from an outer circumference of the blade 2 and surrounds the plurality of blades 2, has a lower part which is integrally connected with the fixed member of the motor and is locked to the micro-processor by a separate fastening means such as a screw.

Specifically, as seen in FIG. 1 a fine guide gap 3*a* which is defined between the outer circumferences of the blades 2 and an inner circumference of the duct 3 performs a function of a guider which guides smoothly outside air sucked by the blade 2 into the micro-processor.

Accordingly, if the hub 1 begins to rotate as electric power is supplied to the motor, the plurality of blades 2 which are integrally formed with the hub 1 are rotated, and outside air is sucked into the micro fan by pressure differentials between surfaces of the blades 2, to be supplied to the micro-processor.

The air flow is effected by the fact that, by a surface contour of the blade 2 which is curved upward, pressure is abruptly reduced inside rather than outside the surface of the blade 2 when the blade 2 is integrally rotated with the hub 1 and according to this, air flows from a point of high pressure toward a point of low pressure.

However, because most micro fans which are used in these days are manufactured only for the purpose of sucking air from the outside, a configuration of the blade 2 is designed in a simple way. Namely, while volume flow rate of the fan is determined by blade size, blade configuration, running rpm, etc., the cross-section of the blade 2 which is applied to the conventional micro fan has a simple configuration as shown in FIG. 2 in which both ends of a lower surface being a straight line are connected with each other by a circular arc having a predetermined radius, a blade angle which is an inclination angle of the blade 2 with respect to the hub is the same at a root and a tip of the blade 2, a camber ratio which is a ratio of a maximum height difference between the lower surface and a thickness center line to a length of the lower surface is about 10% which is a somewhat large value, and a chord line length is the same at the root and the tip of the blade 2.

If the plurality of blades 2 which are integrally coupled to the hub 1 are driven, when observing at various rpms, that is, at 8500 rpm, 9500 rpm and 10500 rpm, variations in wind pressure of the blades depending upon variations in volume flow rate which is generated by the micro fan, performance characteristics which are given in TABLE 1 are obtained.

TABLE 1

| Volume Flow Rate (cmm) | Wind Pressure (mmAq) 8500 rpm | 9500 rpm | 10500 rpm | Volume Flow Rate (cmm) | Wind Pressure (mmAq) 8500 rpm | 9500 rpm | 10500 rpm |
|---|---|---|---|---|---|---|---|
| 0 | 1.4306 | 1.6943 | 2.2725 | 0.017 | 0.3564 | 0.4684 | 0.655 |
| 0.001 | 1.3435 | 1.6129 | 2.1748 | 0.018 | 0.3357 | 0.4476 | 0.6426 |
| 0.002 | 1.2357 | 1.497 | 2.0445 | 0.019 | 0.3191 | 0.4228 | 0.6343 |
| 0.003 | 1.1444 | 1.385 | 1.9223 | 0.02 | 0.2734 | 0.4103 | 0.6135 |
| 0.004 | 1.0449 | 1.2813 | 1.8042 | 0.021 | 0.2361 | 0.3688 | 0.5845 |
| 0.005 | 0.9495 | 1.1818 | 1.6984 | 0.022 | 0.178 | 0.3315 | 0.5638 |
| 0.006 | 0.85 | 1.0822 | 1.5592 | 0.023 | 0.1241 | 0.2776 | 0.5264 |
| 0.007 | 0.7712 | 0.9785 | 1.4472 | 0.024 | 0.0661 | 0.2237 | 0.4974 |
| 0.008 | 0.6675 | 0.8831 | 1.3186 | 0.025 | 0 | 0.178 | 0.4476 |
| 0.009 | 0.5804 | 0.7919 | 1.2067 | 0.026 | | 0.1075 | 0.3896 |
| 0.01 | 0.5057 | 0.7048 | 1.0864 | 0.027 | | 0.0536 | 0.3232 |
| 0.011 | 0.4435 | 0.6094 | 0.991 | 0.028 | | 0 | 0.2651 |
| 0.012 | 0.4145 | 0.5555 | 0.8707 | 0.029 | | | 0.1863 |
| 0.013 | 0.4103 | 0.5223 | 0.7919 | 0.03 | | | 0.1158 |
| 0.014 | 0.4062 | 0.5099 | 0.7421 | 0.031 | | | 0.0412 |
| 0.015 | 0.3979 | 0.4933 | 0.6882 | 0.032 | | | 0 |
| 0.016 | 0.3813 | 0.485 | 0.6758 | 0.033 | | | |

On the other hand, FIG. 3 is a graph which is made using performance characteristics as given in TABLE 1.

From the performance characteristic variations given and illustrated in the TABLE 1 and the FIG. 3, respectively, it is to be readily understood that the more volume flow rate is decreased, the more wind pressure of the micro fan is increased, and the more volume flow rate is increased, the more wind pressure of the micro fan is decreased.

Also, it is to be readily understood that these wind pressure characteristic variations are effected also depending upon rpm of the blade.

On the other hand, as can be seen from TABLE 1 and FIG. 3, when wind pressure is decreased by the increase in volume flow rate, a surging phenomenon in which air flow is unstabilized occurs at a point where wind pressure reduction slope is changed from an abrupt one to a gradual one. By this, there is caused a problem in that fan driving efficiency is deteriorated.

This is because a stall which retards a performance characteristic occurs when wind pressure is abruptly varied. If a hub ratio is increased, air supplying performance characteristics reveal a tendency that highest pressure is increased, a slope of a driving region is steepened and a depth of the stall is deepened.

Accordingly, due to the fact that desired cooling efficiency cannot be achieved by the conventional micro fan, overheating of a device is caused, and in order to cope with this problem, a motor having larger load capacity must be used for increasing rotating force of the micro fan.

Further, since vortex flow is structurally generated at the tip which is the outer circumference of the blade, separation of air flow is brought about, and a peripheral flow field is disturbed by the separation of air flow, whereby performance of the micro fan is impaired and noise is increased.

On the other hand, because a micro-processor of a high capacity and a high speed which have been recently developed must provide a more shortened processing time, a proper cooling cannot be implemented by the conventional blade configuration. Due to this aspect, the development of a fan blade which can satisfy the above condition has drawn considerable attention with increasing demand.

SUMMARY OF THE INVENTION

Accordingly, the present invention has been made in an effort to solve the problems occurring in the related art, and an object of the present invention is to provide a micro fan which has an airfoil-shaped cross-section and is twisted in its configuration at a predetermined angle from a root thereof toward a tip thereof, thereby maximizing wind pressure and volume flow rate.

Another object of the present invention is to provide a micro fan which has improved rotating efficiency, thereby considerably reducing noise.

Still another object of the present invention is to provide a micro fan which has decreased rotation load, thereby lessening power consumption.

In order to achieve the above objects, according to one aspect of the present invention, there is provided a micro fan comprising: a hub rotatably mounted to a shaft, and a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 2°–12° of helical twist.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Generally, in order to accomplish a high performance in a micro fan, rotational velocity, blade angle, the number of blades, blade configuration, etc. must be considered as important factors when the micro fan is designed. Among these factors, blade configuration is most important to minimize flow loss between an inlet and an outlet at a blade and to maximize a static pressure rise.

Most configurations for a blade, which are applied when designing a blade are identified using the NACA (National Advisory Committee for Aeronautics) identification system of the United States of America, or the Circular Arc identification system of the United Kingdom. At this time, an angle of a blade is determined so as to prevent energy loss due to separation of air.

In the present invention, in order to achieve an optimum blade configuration, an airfoil shape according to the NACA identification system, which is most widely used nowadays, is employed. Then, a twist angle is given to the blade which has a shape of an airfoil, to change factors such as camber, thickness, etc. of the airfoil-shape, thereby rendering an optimum blade.

Specifically, the present invention adopts an NACA 4 airfoil which is mainly used over a low velocity zone, and thereafter, an optimum thickness of the blade, a chord line length, etc. are applied to the airfoil-shaped blade.

Figure 1:
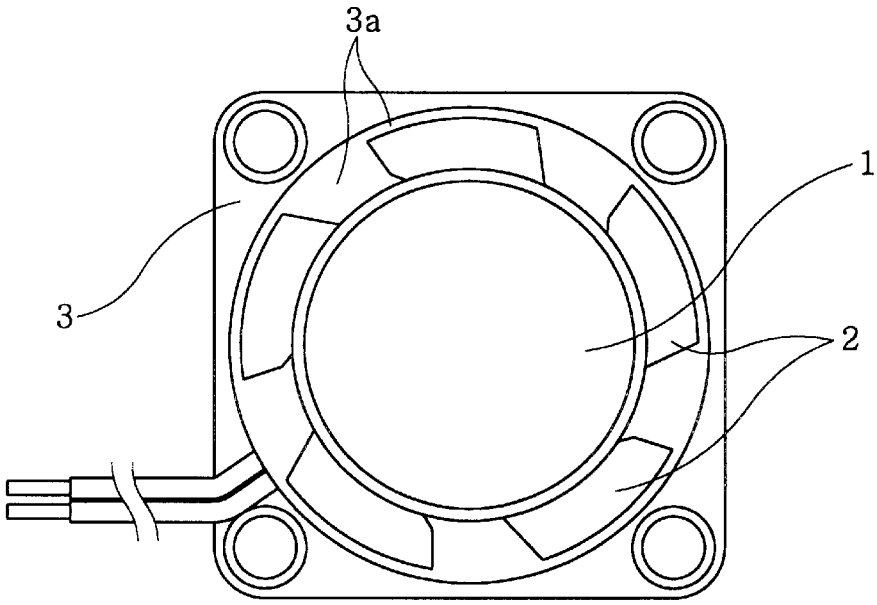
FIG.1 (CONVENTIONAL ART)
FIG. 1 is a front view of a conventional micro fan.
Figure 2:
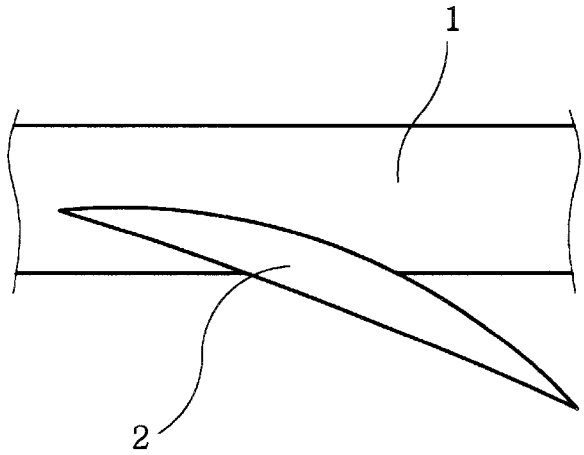
FIG.2 (CONVENTIONAL ART)
FIG. 2 is an enlarged partial plan view illustrating a blade configuration of the micro fan of FIG. 1.
Figure 3:
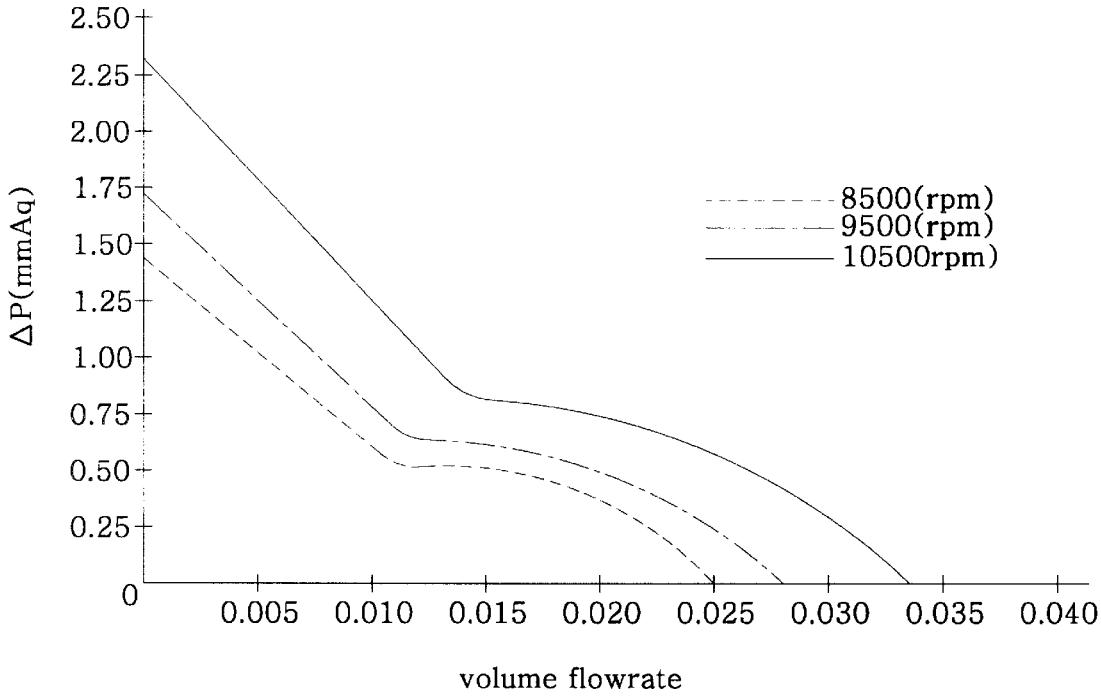
FIG. 3 is a graph showing performance characteristics of micro fans which employ the blade configuration of FIG. 2.
Figure 4:
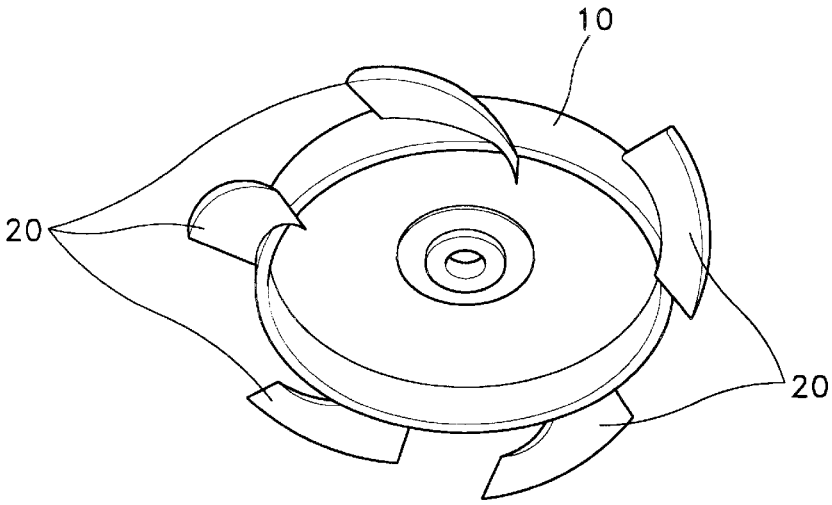
FIG. 4 is a perspective view of a micro fan in accordance with an embodiment of the present invention.
Figure 5:
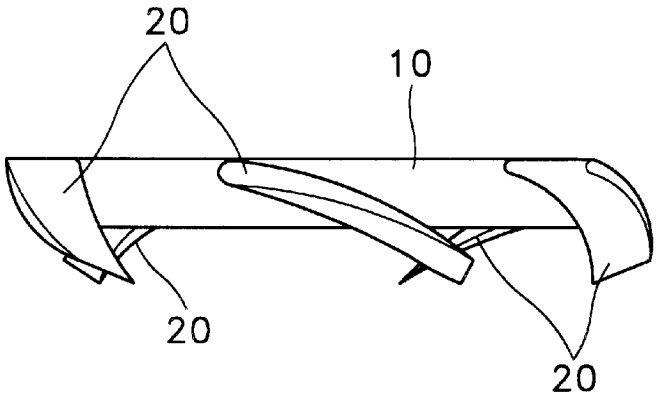
FIG. 5 is a plan view of the micro fan of FIG. 4.

FIG. 4 is a perspective view of a micro fan in accordance with an embodiment of the present invention, and FIG. 5 is a plan view of the micro fan of FIG. 4.

Accordingly, in the present invention, a plurality of blades 20 are integrally and radially formed on a circumferential outer surface of a hub 10 of a motor, and at this time, each blade 20 has an NACA 4 airfoil-shaped cross-section. The blade 20 has a configuration in which a surface thereof is twisted at a predetermined angle.

Figure 6:
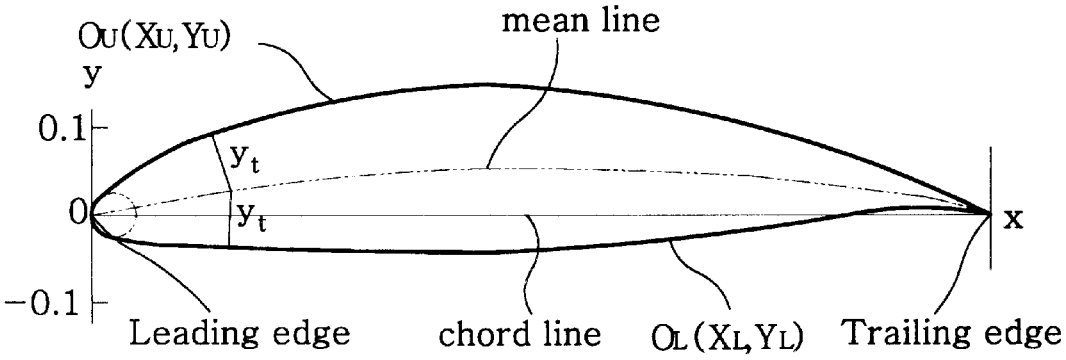
FIG. 6 is a transverse cross-sectional view illustrating a blade of the micro fan according to the present invention.

FIG. 6 is a transverse cross-sectional view illustrating a blade of the micro fan according to the present invention. As described above, in the present invention, the blade 20 has an airfoil-shaped cross-section, and is formed by a method in which a mean line and a thickness distribution are combined with each other.

In the drawings, one end of the airfoil-shaped cross-section of each blade 20, which is rounded at a predetermined radius, is called a leading edge, and the other end of the airfoil-shaped cross-section of each blade 20, which is opposed to the leading edge, is called a trailing edge.

A straight line which connects the leading edge and the trailing edge with each other, is called a chord line, and a thickness center line between the leading edge and the trailing edge is called a mean line.

At this time, the mean lines comprise two parabolas when viewed from points where a Y-coordinate has a maximum value, and at this time, two parabolic equations are defined as given below:

$$y_c = \frac{m}{p}(2px - x^2)$$

Further, a thickness distribution of the blade with $$y_c = \frac{m}{(1-p)^2}[(1-2p) + 2px - x^2]$$

respect to the mean line is given by an equation:

$$\pm y_t = \frac{t}{0.20}\left(0.29690\sqrt{x} - 0.12600x - 0.35160x^2 + 0.28430x^3 - 0.10150x^4\right)$$

On the other hand, an upper surface ($O_U$) and a lower surface ($O_L$) of the blade depending upon the thickness distribution, can be obtained by equations given below: for the upper surface ($O_U$), $$x_U = x - y_t \sin\theta,\ y_U = y_C + y_t \cos\theta$$

for the lower surface ($O_L$), $$x_L = x + y_t \sin\theta,\ y_L = y_C - y_t \cos\theta$$

where $$\theta = \tan^{-1}(dy_c/dx)$$

Moreover, while the leading edge which is one end of the NACA 4 airfoil-shaped cross-section of the blade, is rounded at the predetermined radius, at this time, the radius as being a slope at a point where x/c=0.005 satisfies an equation $r_t = 1.1019t^2$, when drawing a straight line from an end point of the chord line.

On the other hand, in the above described equations, definitions as described below are used:

- c: chord line length
- m: maximum ordinate of the mean line in a fraction of the chord
- p: chordwise position of m
- $r_t$: leading edge radius corresponding to the thickness ratio t
- t: maximum thickness of section in a fraction of the chord
- x: abscissa of a point on the surface of a chord line
- $x_L$: abscissa of a point on the lower surface of a wing section
- $x_U$: abscissa of a point on the upper surface of a wing section
- $x_c$: abscissa of a point on the mean line
- $y_L$: ordinate of a point on the lower surface of a wing section
- $y_U$: ordinate of a point on the upper surface of a wing section
- $y_c$: ordinate of a point on the mean line
- $y_t$: ordinate of a point on the surface of a symmetrical section The airfoil-shaped blade 20 as described above extends by a predetermined length from a root thereof which is adjacent to the hub 10 toward a tip thereof which is adjacent to a duct of the micro fan. At this time, according to the present invention, a span between the root and the tip of the blade 20 has a helical twist angle θ which satisfies an equation given below:

$$\theta = \tan^{-1}\frac{V_\infty \cdot R}{n\pi D}\left(V_\infty = \frac{Q}{\pi R_{tip}^2}\right)$$

wherein $V_\infty$: freestream velocity

R: spanwise position

D: fan diameter (=$2R_{tip}$)

Q: volumetric flow rate ($m^3$/min)

$R_{tip}$: rotor tip radius (mm)

That is to say, in the present invention, due to the fact that the cross-section of the blade has the NACA 4 airfoil-shaped configuration which is mainly used in a wing of an aircraft and the span which extends from the root of the blade and the tip of the blade is twisted at the predetermined angle, a blade area, a maximum blade thickness and a blade angle can be formed to optimum values.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 7:
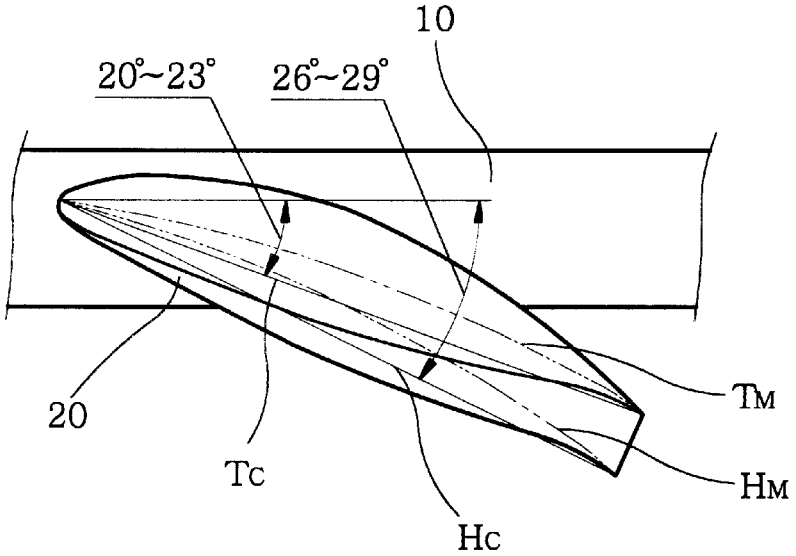
FIG. 7 is a view illustrating a detailed structure of the blade according to the present invention.

FIG. 7 is a view illustrating a detailed structure of the blade according to the present invention. The drawing reference numeral 10 denotes a hub of a motor.

At this time, a cross-section of a blade 20 has an NACA 4 blade configuration, that is, an airfoil-shaped configuration.

In other words, mean lines which are thickness center lines of the blade 20 having the airfoil-shaped configuration, are defined by two parabolic equations when viewed from points where a height difference with respect to a chord line is maximal, as given below:

$$y_c = \frac{m}{p}(2px - x^2)$$

$$y_c = \frac{m}{(1-p)^2}[(1-2p) + 2px - x^2]$$

At this time, mean lines $T_M$ and $H_M$ and chord lines $T_C$ and $H_C$ are formed at a root and a tip of each blade, as shown in FIG. 7.

On the other hand, a thickness distribution of the blade 20 which is based on the mean line, is constant at both the root and the tip of the blade, and is defined by an equation:

$$\pm y_t = \frac{t}{0.20}\left(0.29690\sqrt{x} - 0.12600x - 0.35160x^2 + 0.28430x^3 - 0.10150x^4\right)$$

On the other hand, coordinates of an upper surface and a lower surface of the blade 20 can be obtained using the mean lines and the thickness distribution by equations given below:

$$x_U = x - y_t\sin\theta,\ y_U = y_c + y_t\cos\theta$$

$$x_L x + y_t\sin\theta,\ y_L = y_C - y_t\cos\theta$$

$$\theta = \tan^{-1}(dy_c/dx)$$

Moreover, the leading edge which is one end of the blade 20, is rounded at a radius which is a slope at a point where x/c=0.005 and satisfies an equation $r_t = 1.1019t^2$, when drawing a straight line from an end point of the chord line.

Further, the airfoil-shaped cross-section of the blade has a camber ratio which is a ratio of a maximum height difference (a) between the chord line and the mean line to a chord line length (c), with the camber ratio being represented by a term a/c·100.

On the other hand, the blade 20 having the airfoil-shaped cross-section as described above has a span which extends by a predetermined length from the root thereof which is adjacent to the hub 10 toward the tip thereof which is adjacent to a duct of the micro fan. At this time, according to the present invention; the span between the root and the tip of the blade 20 has a helical twist angle θ which satisfies an equation given below:

$$\theta = \tan^{-1}\frac{V_\infty \cdot R}{n\pi D}\left(V_\infty = \frac{Q}{\pi R_{tip}^2}\right)$$

In order to obtain this helical twist, in the present embodiment, as shown in FIG. 7, the root and the tip of the blade 20 are formed such that they have different blade angles.

The helical twist is determined by setting angles of the root and the tip of the blade which are called blade angles, that is, inclination angles of the chord lines with respect to parallel lines which are drawn from the leading edges of the root and the tip, respectively. At this time, a blade angle which is an inclination angle of the chord line $H_c$ with respect to a horizontal line of the hub 10 which is drawn from the leading edge of the root of the blade, is about 24°–34°, and a blade angle of the tip of the blade which is adjacent to the duct of the micro fan is about 18°–28°.

In addition, it is most preferred that the camber ratio (a/c·100) which is a ratio of a maximum height difference between the chord line and the mean line to a chord line length at the respective cross-sections having the blade angles as just described above, is 4–16%.

Also, it is most preferred that a difference between the blade angles at the root and the tip of the blade is 2°–12°.

A most preferred configuration of the blade constructed as mentioned above has a camber ratio of 8%, a blade angle of 28.79° at the root of the blade, a blade angle of 22.57° at the tip of the blade, and a twist angle of 6.22° from the root toward the tip of the blade.

Figure 8:
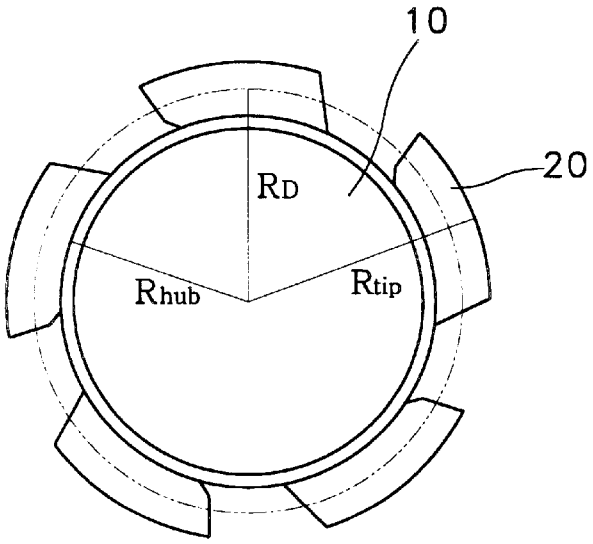
FIG. 8 is a front view of the micro fan according to the present invention.

Besides, as shown in FIG. 8, by forming the chord line length which is a length between the leading edge and the trailing edge of the blade, such that it is lengthened at the tip rather than the root of the blade, it is possible to maximize flowability of intake air at the tip of the blade.

In FIG. 8, $R_D$ is a duct radius (mm), $R_{hub}$ is a rotor hub radius (mm) and $R_{tip}$ is a rotor tip radius (mm). While it is preferred that a gap between the tip of the blade 20 and the duct is as narrow as possible, due to difficulties in manufacturing, it is most preferred that a gap of 0.5 mm is maintained.

Characteristic variations depending upon multi-stepwise rpm variations in the micro fan according to the present embodiment are illustrated in TABLE 2.

TABLE 2

| Volume Flow Rate (cmm) | Wind Pressure (mmAq) 8500 rpm | 9500 rpm | 10500 rpm | Volume Flow Rate (cmm) | Wind Pressure (mmAq) 8500 rpm | 9500 rpm | 10500 rpm |
|---|---|---|---|---|---|---|---|
| 0 | 1.8775 | 2.358 | 2.928 | 0.018 | 0.5057 | 0.7255 | 1.0407 |
| 0.001 | 1.7757 | 2.248 | 2.8058 | 0.019 | 0.4642 | 0.6799 | 0.9785 |
| 0.002 | 1.6699 | 2.1218 | 2.6756 | 0.02 | 0.4311 | 0.6426 | 0.9246 |
| 0.003 | 1.5675 | 1.9875 | 2.529 | 0.021 | 0.3854 | 0.6053 | 0.8707 |
| 0.004 | 1.4555 | 1.8857 | 2.4068 | 0.022 | 0.3357 | 0.5555 | 0.8209 |
| 0.005 | 1.356 | 1.7757 | 2.2725 | 0.023 | 0.2776 | 0.5099 | 0.7836 |
| 0.006 | 1.2564 | 1.6577 | 2.1544 | 0.024 | 0.2278 | 0.4599 | 0.738 |
| 0.007 | 1.1693 | 1.5053 | 2.0241 | 0.025 | 0.1656 | 0.3979 | 0.6882 |
| 0.008 | 1.0739 | 1.4182 | 1.9142 | 0.026 | 0.0992 | 0.3398 | 0.6343 |
| 0.009 | 0.991 | 1.3145 | 1.8002 | 0.027 | 0.0246 | 0.2776 | 0.5762 |
| 0.01 | 0.9288 | 1.2274 | 1.6943 | 0.028 | | 0.2071 | 0.4601 |
| 0.011 | 0.8541 | 1.1444 | 1.6007 | 0.029 | | 0.1241 | 0.3979 |
| 0.012 | 0.7877 | 1.0822 | 1.5177 | 0.03 | | 0.495 | 0.3191 |
| 0.013 | 0.7172 | 1.0325 | 1.4265 | 0.031 | | 0.0038 | 0.2444 |
| 0.014 | 0.6592 | 0.9288 | 1.356 | 0.032 | | | 0.1615 |
| 0.015 | 0.6053 | 0.8707 | 1.2647 | 0.033 | | | 0.0785 |
| 0.016 | 0.5638 | 0.8251 | 1.1859 | 0.034 | | | 0.008 |
| 0.017 | 0.5347 | 0.7794 | 1.1071 | 0.035 | | | |

Figure 9:
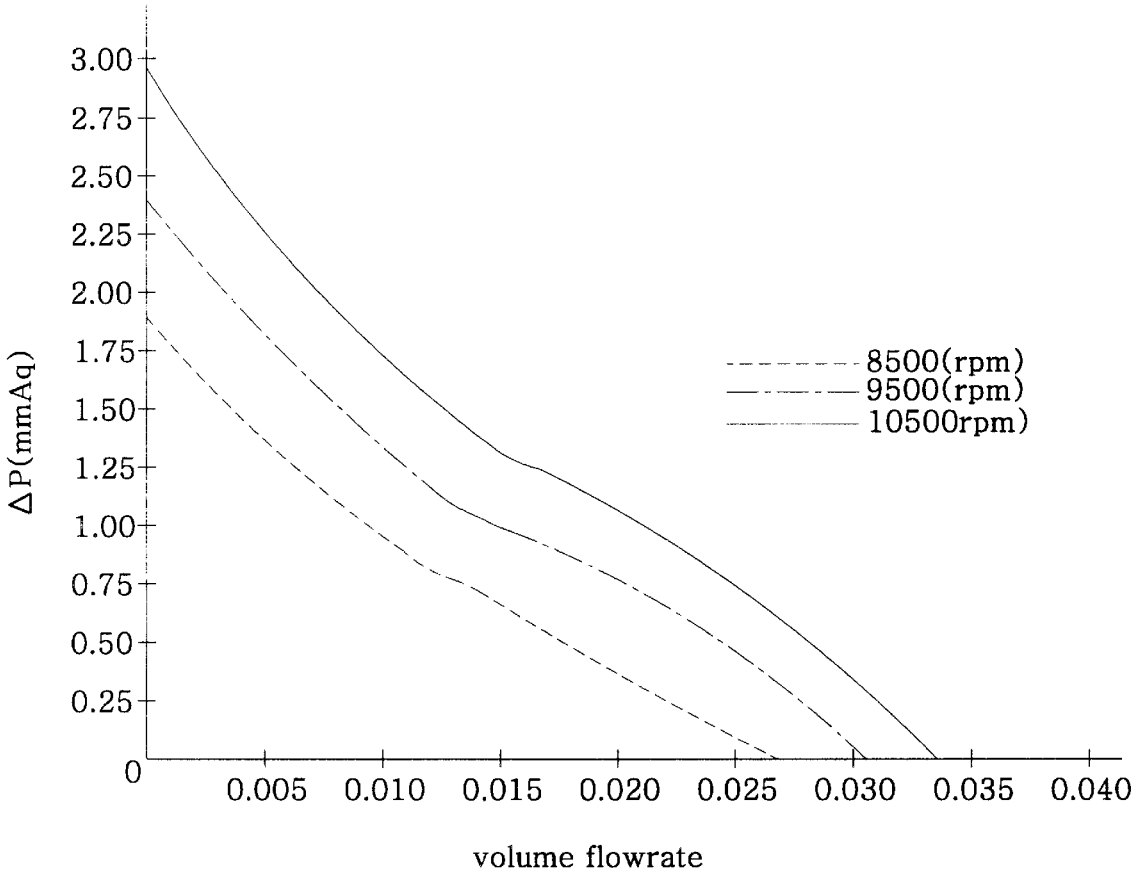
FIG. 9 is a graph showing performance characteristics of micro fans which employ a blade configuration according to the present invention.

FIG. 9 is a graph showing the characteristic variations of TABLE 2. From FIG. 9, it is to be readily understood that a wind pressure variation relative to a volume flow rate variation is remarkably gradual when compared to the conventional micro fan.

On the other hand, the micro fan according to the present invention can be formed from the following absolute coordinates.

In other words, the plurality of blades 20 are formed on the circumferential outer surface of the hub 10 which is rotatably mounted to a shaft, and at the same time, coordinates of the upper surface at the root of the blade are as described in TABLE 3 given below:

TABLE 3

| X | Y | Z |
|---|---|---|
| 0.000000 | 0.000000 | 8.700000 |
| −0.138667 | 0.848028 | 8.658570 |
| 0.004639 | 1.625992 | 8.546704 |
| 0.264198 | 2.327542 | 8.382873 |
| 0.619004 | 2.944328 | 8.186631 |
| 1.029781 | 3.473029 | 7.976720 |
| 1.480217 | 3.941332 | 7.756023 |
| 1.96664 | 4.353728 | 7.532268 |
| 2.486875 | 4.715405 | 7.311290 |
| 3.039662 | 5.031621 | 7.097379 |
| 3.624660 | 5.307311 | 6.893652 |

coordinates of the upper surface at the tip of the blade are as described in TABLE 4 given below:

TABLE 4

| X | Y | Z |
|---|---|---|
| 0.000000 | 0.000000 | 11.350000 |
| −0.214333 | 1.023977 | 11.303720 |
| −0.126138 | 1.997808 | 11.172790 |
| 0.099048 | 2.894330 | 10.974760 |
| 0.440899 | 3.699310 | 10.730220 |
| 0.856263 | 4.404663 | 10.460470 |
| 1.321298 | 5.036864 | 10.171160 |
| 1.832326 | 5.599416 | 9.872642 |
| 2.387100 | 6.097404 | 9.573096 |

TABLE 4-continued

| X | Y | Z |
|---|---|---|
| 2.984470 | 6.536602 | 9.278758 |
| 3.624168 | 6.922854 | 8.994254 |

coordinates of the lower surface at the root of the blade are as described in TABLE 5 given below:

TABLE 5

| X | Y | Z |
|---|---|---|
| 0.000000 | 0.000000 | 8.700000 |
| 0.396161 | 0.737933 | 8.668648 |
| 0.644208 | 1.437582 | 8.580405 |
| 0.909862 | 2.082332 | 8.447124 |
| 1.214126 | 2.670698 | 8.279938 |
| 1.559095 | 3.222821 | S.081054 |
| 1.923898 | 3.725567 | 7.860521 |
| 2.312183 | 4.187325 | 7.626029 |
| 2.726197 | 4.600498 | 7.384133 |
| 3.167128 | 4.970913 | 7.140029 |
| 3.635339 | 5.302281 | 6.897522 |

coordinates of the lower surface at the tip of the blade are as described in TABLE 6 given below:

TABLE 6

| X | Y | Z |
|---|---|---|
| 0.000000 | 0.000000 | 11.350000 |
| 0.329121 | 0.968701 | 11.308590 |
| 0.530347 | 1.872718 | 11.194440 |
| 0.769176 | 2.709496 | 11.021850 |
| 1.066046 | 3.477411 | 10.804170 |
| 1.415488 | 4.196884 | 10.545550 |
| 1.792875 | 4.856730 | 10.258400 |
| 2.201882 | 5.456312 | 9.952446 |
| 2.644758 | 5.997341 | 9.636100 |
| 3.122651 | 6.483214 | 9.316138 |
| 3.635830 | 6.918398 | 8.997682 |

By forming the blade 20 in conformity with the coordinates as given above, it is possible to accomplish a configuration in which a cross-section of the blade has an airfoil-shaped contour, and a blade angle has a helical twist of a predetermined twist angle from the root of the blade toward the tip of the blade.

As described above, according to the present invention, advantages are provided in that since volume flow rate and a static pressure rise are improved as compared to the conventional micro fan, a gap defined at a tip of the blade is reduced to lessen influence of drag force or friction due to vortex flow in the gap, whereby more efficient air flow is ensured on a blade surface.

In addition, because a helical twist is applied to the blade, a pressure reduction due to surging is prevented, whereby resistance is reduced, decreasing noise.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A micro fan comprising:

a hub rotatably mounted to a shaft, and a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 2°–12° of helical twist.

2. A micro fan comprising:

a hub rotatably mounted to a shaft, and a plurality of blades radially formed on a circumferential outer surface of the hub, wherein each blade has an airfoil-shaped cross-section which generates lift force larger than drag force;

wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 20–12° of helical twist;

wherein, in each blade, the root has a chord line length which is longer than that of the tip.

3. A micro fan comprising:

a hub rotatably mounted to a shaft, and a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a camber ratio in the airfoil-shaped cross-section of each blade, which is a ratio of a maximum height difference between the chord line and the mean line (a) to a chord line length (c), as represented by $(a/c)\cdot 100$, is 4–16%, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 2°–12° of helical twist.

4. A micro fan comprising:

a hub rotatable mounted to a shaft, a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a man line, and an inclination angle of the chord line with respect to parallel line which is drawn from the leading edge is a blade angle, a camber ratio in the airfoil-shaped cross-section of each blade, which is a ratio of a maximum height difference between the chord line and the mean line (a) to a chord line length (c), as represented by $(a/c)\times 100$, is 4–16%, a blade angle at a root of the blade which is adjacent to the hub is about 24°–34°, a blade angle at a tip of the blade which is adjacent to a duct of the micro fan is about 18°–28°, and a span twist angle which is represented by a difference between the blade angles at the root and the tip is 2°–12° of helical twist;

wherein, in each blade, the root has a chord line length which is longer than that of the tip.

5. A micro far comprising:

a hub rotatably mounted to a shaft, and a plurality of blades radially formed on a circumferential outer surface of the hub, wherein each blade has an airfoil-shaped cross-section which generates lift force larger than drag force; and wherein, when assuming that one end of the airfoil-shaped cross-section of each blade, which is rounded at a predetermined radius, is a leading edge, the other end of the airfoil-shaped cross-section of each blade is a trailing edge, a straight line which connects the leading edge and the trailing edge with each other is a chord line, a thickness center line between the leading edge and the trailing edge is a mean line, and an inclination angle of the chord line with respect to a parallel line which is drawn from the leading edge is a blade angle, a camber ratio in the airfoil-shaped cross-section of each blade, which is a ratio of a maximum height difference between the chord line and the mean line (a) to a chord line length (c), as represented by $(a/c)\cdot 100$, is 8%, a blade angle at a root of the blade which is adjacent to the hub is about 28.79°, a blade angle at a tip of the blade which is adjacent to a duct of the micro fan is about 22.57°, and a span twist angle which is represented by a difference between the blade angles at the root and the tip is 6.22° of helical twist.

6. A micro fan as claimed in claim 5, wherein, in each blade, the root has a chord line length which is longer than that of the tip.

* * * * *